US009384924B2

(12) United States Patent
Yamashita et al.

(10) Patent No.: US 9,384,924 B2
(45) Date of Patent: Jul. 5, 2016

(54) GAS CIRCUIT BREAKER

(75) Inventors: Toru Yamashita, Tokyo (JP); Daisuke Yoshida, Tokyo (JP); Hirokazu Otani, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/382,233

(22) PCT Filed: May 22, 2012

(86) PCT No.: PCT/JP2012/063008

§ 371 (c)(1),
(2), (4) Date: Aug. 29, 2014

(87) PCT Pub. No.: WO2013/175565

PCT Pub. Date: Nov. 28, 2013

(65) Prior Publication Data

US 2015/0060411 A1 Mar. 5, 2015

(51) Int. Cl.

*H01H 33/64* (2006.01)
*H01H 33/90* (2006.01)
*H01H 33/88* (2006.01)

(52) U.S. Cl.

CPC ..... *H01H 33/64* (2013.01); *H01H 33/903* (2013.01); *H01H 2033/888* (2013.01); *H01H 2033/908* (2013.01)

(58) Field of Classification Search

CPC ..... H01H 33/91; H01H 2033/888; H01H 2033/908; H01H 33/703; H01H 33/7046; H01H 33/98; H01H 9/302

See application file for complete search history.

(56) References Cited

U.S. PATENT DOCUMENTS 4,983,789 A 1/1991 Thuries
5,155,314 A 10/1992 Dufournet et al.

(Continued)

FOREIGN PATENT DOCUMENTS

JP 54-90576 A 7/1979
JP 58-75723 A 5/1983

(Continued)

OTHER PUBLICATIONS

International Search Report (PCT/ISA/210) mailed on Aug. 28, 2012, by the Japanese Patent Office as the International Searching Authority for International Application No. PCT/JP2012/063008.

(Continued)

*Primary Examiner* — Truc Nguyen
(74) *Attorney, Agent, or Firm* — Buchanan Ingersoll & Rooney PC

(57) ABSTRACT

Provided are: a hermetically-enclosed tank that is filled with insulating gas; a blocking unit that is provided within the hermetically-enclosed tank and is configured with a movable arc contact and a fixed arc contact opposing each other; a plurality of energizing units, within the hermetically-enclosed tank, that are provided around the blocking unit about its axial line as a center and located away from each other; and a fixed-side auxiliary conductor that is provided between a gas space which stores the energizing units and a gas space on the side of the fixed arc contact. A communication hole is formed on the fixed-side auxiliary conductor so as to communicate the gas space provided between the energizing units with the gas space.

4 Claims, 5 Drawing Sheets

(56) References Cited

U.S. PATENT DOCUMENTS

| | | | | |
|---|---|---|---|---|
| 5,179,257 | A | 1/1993 | Dufournet et al. | |
| 5,483,210 | A * | 1/1996 | Otterberg | H01H 1/46 335/18 |
| 5,793,597 | A * | 8/1998 | Mizufune | H01H 33/7015 218/52 |
| 6,163,001 | A | 12/2000 | Zehnder et al. | |
| 6,744,001 | B2 * | 6/2004 | Perret | H01H 33/901 218/53 |
| 2008/0011719 | A1 * | 1/2008 | Saxl | H01H 33/70 218/157 |
| 2009/0120910 | A1 * | 5/2009 | Chyla | H01H 33/7046 218/84 |
| 2011/0062116 | A1 * | 3/2011 | Kriegel | H01H 33/901 218/43 |
| 2011/0297648 | A1 * | 12/2011 | Dienemann | H01H 33/703 218/54 |
| 2013/0161288 | A1 | 6/2013 | Yamashita et al. | |
| 2014/0202991 | A1 | 7/2014 | Yamashita et al. | |

FOREIGN PATENT DOCUMENTS

| | | | |
|---|---|---|---|
| JP | 61-3644 | U | 1/1986 |
| JP | 62-31920 | A | 2/1987 |
| JP | 62-276718 | A | 12/1987 |
| JP | 02-094220 | A | 4/1990 |
| JP | 2-230625 | A | 9/1990 |
| JP | 2562086 | B2 | 12/1996 |
| JP | 2568304 | B2 | 1/1997 |
| JP | 9-102253 | A | 4/1997 |
| JP | 11-329191 | A | 11/1999 |
| JP | 11-353985 | A | 12/1999 |
| JP | 2009-059541 | A | 3/2009 |

OTHER PUBLICATIONS

Written Opinion (PCT/ISA/237) mailed on Aug. 28, 2012, by the Japanese Patent Office as the International Searching Authority for International Application No. PCT/JP2012/063008.

First Office Action dated Dec. 1, 2015 issued in corresponding Chinese Patent Application No. 201280073316.2 and English translation (9 pages).

* cited by examiner

GAS CIRCUIT BREAKER

FIELD

The present invention relates to a gas circuit breaker that is applied to an electric power system for power generation, power transformation, and the like, and that blocks an electric current by using insulating gas such as sulfur hexafluoride (SF6) gas having high arc-extinguishing properties.

BACKGROUND

As a conventional gas circuit breaker, there is a mechanical puffer-type gas circuit breaker, in which a part of insulating gas such as SF6 gas is filled in a hermetically-enclosed tank and is compressed along with an opening operation with a mechanical force by an operation device. The gas is blown down onto an arc generated between contacts with the increased gas pressure and extinguishes the arc.

For example, in a conventional gas circuit breaker described in Patent Literature 1 mentioned below, a blocking unit that blocks an electric current is provided within a hermetically-enclosed tank, and four energizing units are concentrically provided so as to surround the blocking unit. The blocking unit and the energizing units are provided on a fixed-side auxiliary conductor and a movable-side auxiliary conductor. An insulating cylinder is provided along an outer peripheral portion around the energizing units. A fixed-side cylindrical conductor is connected to one end of the insulating cylinder via the fixed-side auxiliary conductor. A movable-side cylindrical conductor is connected to the other end of the insulating cylinder via the movable-side auxiliary conductor. A space in which each of the energizing units is accommodated is almost closed by the insulating cylinder, the blocking unit, the fixed-side auxiliary conductor, and the movable-side auxiliary conductor. A gas space within the fixed-side cylindrical conductor and a gas space within the movable-side cylindrical conductor connect to each other only via an arc-generation area in the blocking unit. The gas circuit breaker configured as described above switches a movable arc contact and a fixed arc contact between open and closed states to generate an arc between these contacts, and blows gas down onto the arc to block an electric current.

CITATION LIST

Patent Literature

Patent Literature 1: Japanese Patent Application Laid-open No. 2009-59541

SUMMARY

Technical Problem

However, the conventional gas circuit breaker described in the Patent Literature 1 mentioned above has the following problems. That is, when an arc is generated between the contacts, high-temperature hot gas flows from the arc area to the fixed-side cylindrical conductor and the movable-side cylindrical conductor; and this hot gas is mixed with original cold gas, thereby increasing the pressure within each of these cylindrical conductors. Because there is not the movable arc contact in the fixed-side cylindrical conductor, hot gas flows into this fixed-side cylindrical conductor even from the initial stage of arc generation. Also, because there is not a mechanism or the like that drives the movable arc contact in the fixed-side cylindrical conductor, the gas capacity in this fixed-side cylindrical conductor is smaller than that in the movable-side cylindrical conductor, which causes the pressure within the gas space in the fixed-side cylindrical conductor to abruptly increase. In this gas circuit breaker, the space in which the energizing units are accommodated is almost closed by the fixed-side auxiliary conductor and the like as described above, and therefore the gas capacity in the fixed-side cylindrical conductor is small. Accordingly, the pressure difference between the blocking unit and the gas space in the fixed-side cylindrical conductor is relatively small. Consequently, hot gas generated in the blocking unit flows to the gas space in the fixed-side cylindrical conductor at a low velocity. Thus, the discharge of the hot gas from the arc area delays, which makes the blocking performance lower. In order to increase the flow velocity of the hot gas from the arc area, the gas space in the fixed-side cylindrical conductor needs to be increased, which means there is a trade-off relation between predetermined blocking performance and downsizing of a hermetically-enclosed tank. Therefore, there is a problem that the conventional gas circuit breaker cannot meet the needs for downsizing the hermetically-enclosed tank while satisfying predetermined blocking performance.

The present invention has been made to solve the above problems, and an object of the present invention is to provide a gas circuit breaker that can downsize a hermetically-enclosed tank while satisfying predetermined blocking performance.

Solution to Problem

To solve the problem and to achieve the object mentioned above, in the invention, provided is: a hermetically-enclosed tank that is filled with insulating gas; a blocking unit that is provided within the hermetically-enclosed tank and is configured with a movable arc contact and a fixed arc contact opposing each other; a plurality of energizing units, within the hermetically-enclosed tank, that are provided around the blocking unit about its axial line as a center and located away from each other; and a first wall that is provided between a first gas space which stores the energizing units therein and a second gas space into which insulating gas, heated in the blocking unit provided on a side of the fixed arc contact, is diffused. Further, first communication hole is formed on the first wall so as to communicate the first gas space provided between the energizing units with the second gas space.

Advantageous Effects of Invention

According to the present invention, a gas space on the side of a fixed arc contact is configured to communicate with another gas space so that a hermetically-enclosed tank can be effectively downsized while satisfying predetermined blocking performance.

DESCRIPTION OF EMBODIMENTS

Exemplary embodiments of a gas circuit breaker according to the present invention will be explained below in detail with reference to the accompanying drawings. The present invention is not limited to these embodiments.

First Embodiment

Figure 1:
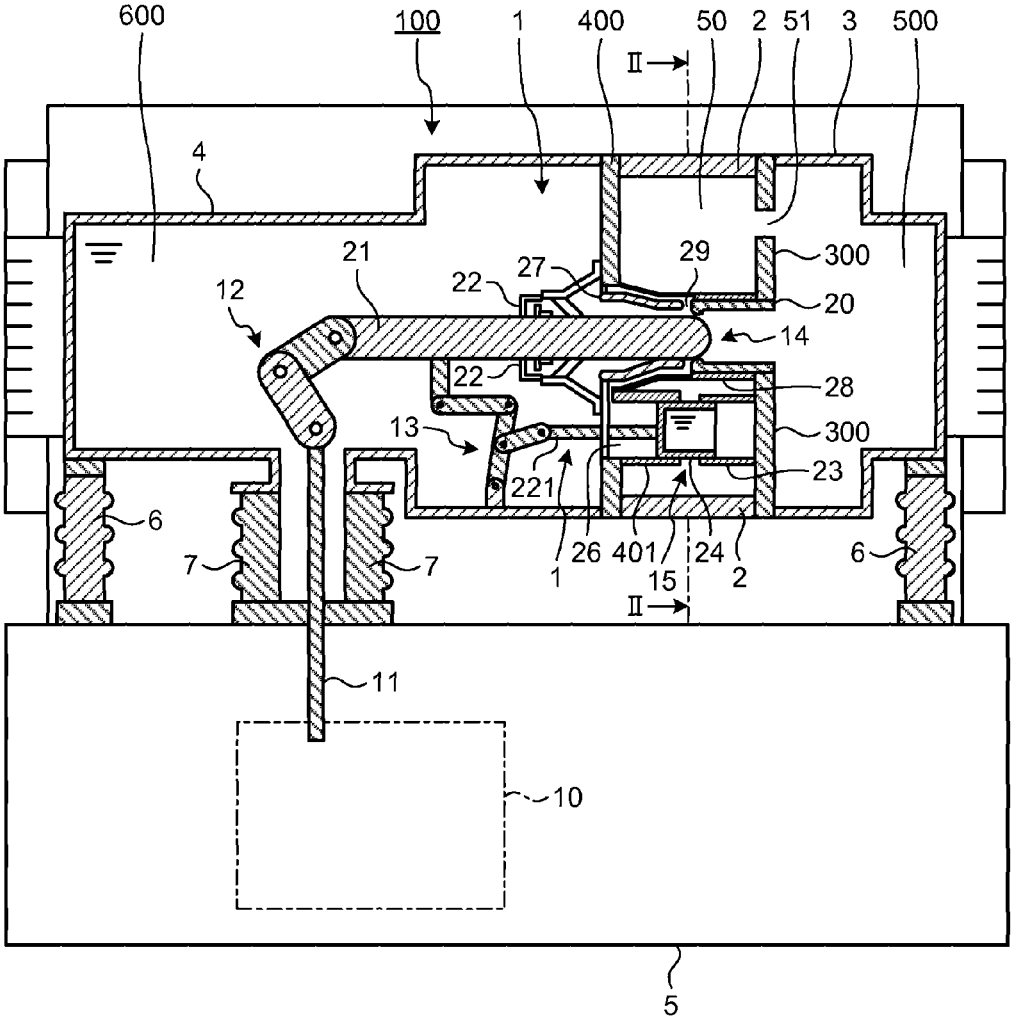
FIG. 1 is a vertical cross-sectional view illustrating a configuration of a gas circuit breaker according to a first embodiment of the present invention.
Figure 2:
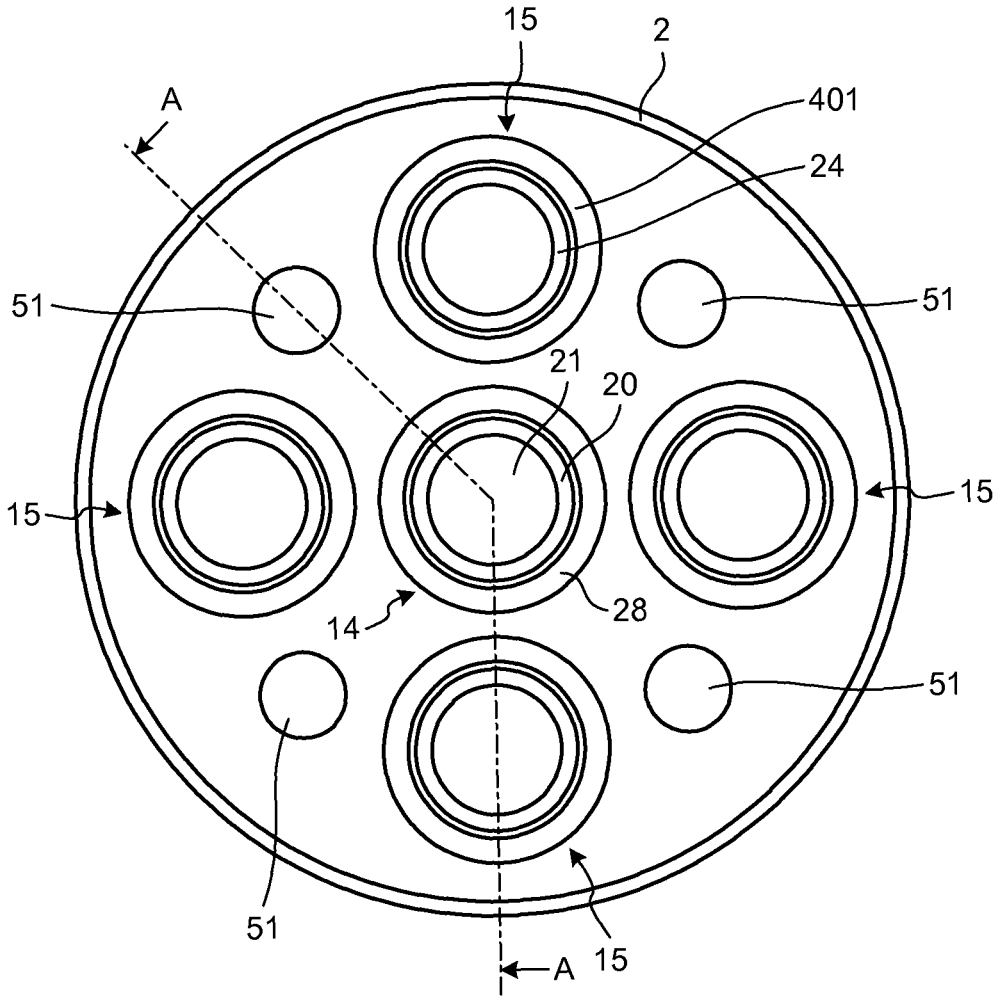
FIG. 2 is a cross-sectional view along a line II-II seen in arrow direction shown in FIG. 1.

FIG. 1 is a vertical cross-sectional view illustrating a configuration of a gas circuit breaker according to a first embodiment of the present invention, which is taken along a line A-A seen in arrow A direction shown in FIG. 2. FIG. 2 is a cross-sectional view along a line II-II seen in arrow direction shown in FIG. 1.

A hermetically-enclosed tank 100 shown in FIG. 1 is configured to be integrally formed with an insulating cylinder 2 made of epoxy resin for example; a fixed-side cylindrical conductor 3 connected to one end of the insulating cylinder 2; and a movable-side cylindrical conductor 4 connected to the other end of the insulating cylinder 2. The hermetically-enclosed tank 100 is filled with insulating gas such as SF6 gas. The hermetically-enclosed tank 100 is supported on a support stand 5 via a support insulator 6 and a support insulator 7. An operation device 10 is provided in the support stand 5. On the side surface of the movable-side cylindrical conductor 4, a hole is formed through which insulating operation rod 11 extends. The insulating operation rod 11 has one end connecting to a link mechanism 12 and the other end connecting to the operation device 10. The support insulator 7 supports the movable-side cylindrical conductor 4 at around the periphery of the hole formed thereon in an insulating manner. The switching of a switching unit 1 is operated by the operation device 10 via the insulating operation rod 11 formed of an insulating member, the link mechanism 12 with its one end being provided inside the hermetically-enclosed tank 100, and a link mechanism 13.

In the hermetically-enclosed tank 100, the switching unit 1 that passes or blocks an electric current is provided. The switching unit 1 is configured with a blocking unit 14 that blocks an electric current and an energizing unit 15 that passes a rated electric current. The blocking unit 14 is configured with a fixed-side auxiliary conductor 300 that is connected to the fixed-side cylindrical conductor 3; a fixed arc contact 20 that is electrically connected to the fixed-side auxiliary conductor 300; and a movable arc contact 21 that is coaxial to and opposing to the fixed arc contact 20.

The movable arc contact 21 is capable of coming into and out of contact with the fixed arc contact 20 on the axial line, and is electrically connected via a rod contact 22 to a movable-side auxiliary conductor 400 connecting to the movable-side cylindrical conductor 4. One end of the movable arc contact 21 is connected to the link mechanism 12; and the movable arc contact 21 is capable of reciprocating linearly in the axial-line direction by the operation device 10 via the link mechanism 12 and the insulating operation rod 11. The movable arc contact 21 is linked with the mechanism 13; and a movable energizing contact 24 is configured to reciprocate in the axial-line direction via the link mechanism 13 in conjunction with the operation of the movable arc contact 21.

The energizing unit 15 is configured with a movable-side cylindrical conductor 401, the fixed-side auxiliary conductor 300, a fixed energizing contact 23 that is electrically connected to the fixed-side auxiliary conductor 300, and the movable energizing contact 24 that is of cylindrical shape and opposing to the fixed energizing contact 23. The energizing unit 15 is provided within a gas space 50 that is surrounded by the insulating cylinder 2, the fixed-side auxiliary conductor 300, the movable-side auxiliary conductor 400, and an insulating member 28 extending to the movable-side auxiliary conductor 400 along the outer peripheral surface of the fixed arc contact 20.

One end of the movable energizing contact 24 (an end on the side of the fixed energizing contact 23) is of an open state, and this end is fitted into the fixed energizing contact 23 to form a contact state. At the other end of the movable energizing contact 24 (the opposite end to the end on the side of the fixed energizing contact 23), a disk-shaped end plate is provided, and the end plate is coupled with a piston rod 221 via the link mechanism 13 in a fixed manner. According to the reciprocal movement of the movable arc contact 21, the piston rod 221 reciprocates in the same direction, which causes the movable energizing contact 24 to come into and out of contact with the fixed energizing contact 23.

The movable-side cylindrical conductor 401 is connected to the movable-side auxiliary conductor 400, and the movable energizing contact 24 is slidably and electrically connected to the movable-side cylindrical conductor 401 via a ring-shaped contact (not shown). A mechanical puffer chamber 26 is configured with the movable-side auxiliary conductor 400, the movable-side cylindrical conductor 401, and the movable energizing contact 24, and is changed of its volume according to a switching operation between the movable energizing contact 24 and the fixed energizing contact 23.

The insulating member 28 that is connected to the fixed-side auxiliary conductor 300 extends toward the movable side along the outer peripheral surface of the fixed arc contact 20. Further, an insulating nozzle 27 that is connected to the movable-side auxiliary conductor 400 extends toward the fixed side. The mechanical puffer chamber 26 communicates, through a spraying flow passage 29 formed with the insulating nozzle 27 and the insulating member 28, with an arc-generation area where an arc is generated when the fixed arc contact 20 and the movable arc contact 21 come out of contact with each other.

As shown in FIG. 2, four energizing units 15 are provided within the gas space 50. These energizing units 15 are provided, concentrically surrounding the blocking unit 14 with an equal distance with each other for example. Specifically, each of the energizing units 15 is arranged with its axis line parallel to that of the blocking unit 14, and is provided concentrically with a predetermined radius from the axial line of the blocking unit 14 as the center and with a same distance apart from each other, for example. The four energizing units 15 are electrically connected to the blocking unit 14, and the movable energizing contact 24 is capable of coming into and out of contact with the fixed energizing contact 23 along the axial line. In the fixed-side auxiliary conductor 300, a communication hole 51 is formed through which a gas space 500 in the fixed-side cylindrical conductor 3 connects with the gas space 50. The communication holes 51 are formed, for example, at locations between each of the energizing units 15.

Next, described is an operation when the electric current is blocked. A blocking operation generates an arc in the arc-generation area in the blocking unit 14, and the high-temperature hot gas generated by the arc first flows along the inner-surface side of the fixed arc contact 20 into the gas space 500.

In the gas space 500, gas that has been present in the gas space 500 is mixed with the hot gas flowing from the blocking unit 14, which makes the pressure within the gas space 500 increase and which makes a part of the mixed gas flow into the gas space 50 through the communication hole 51.

Because the communication hole 51 is formed between the energizing units 15, gas that flows into the gas space 50 through the communication hole 51 does not directly blow onto the movable energizing contact 24, the fixed energizing contact 23, a mechanical puffer, and the like. Further, the gas space 500 and the gas space 50 connect to each other through the communication hole 51, so that the gas space 500 is relatively enlarged, and therefore, the difference between the gas pressure around the blocking unit 14 and that in the gas space 500 becomes relatively large. As the gas pressure difference becomes larger, the gas flow velocity becomes higher. Therefore, the hot gas generated in the blocking unit 14 flows into the gas space 500 at a higher velocity, making it possible for the hot gas to be discharged from the arc area more quickly, which can bring about improvement of the blocking performance. Thus, it is possible to downsize the hermetically-enclosed tank 100 while satisfying predetermined blocking performance.

Further, when the movable arc contact 21 moves leftward shown in FIG. 1, a gas flow passage to the gas space 600 in the movable-side cylindrical conductor 4 is enlarged, so that the gas pressure in the arc-generation area decreases and relatively higher-pressure insulating gas is blown onto an arc. With this operation, the arc is extinguished, and an electric current is blocked.

Note that, in the first embodiment, four energizing units 15 are provided, which does not mean the number of the energizing units 15 is limited to four. Further, in the first embodiment, the energizing units 15 are concentrically provided with the same distance so as to surround the blocking unit 14, which does not mean the energizing units 15 are limited to an arrangement with a same distance and which does not exclude an arrangement with unequal distance.

As explained above, the gas circuit breaker according to the first embodiment includes: the hermetically-enclosed tank 100 filled with insulating gas; the blocking unit 14 that is configured with the movable arc contact 21 and the fixed arc contact 20 opposing each other within the hermetically-enclosed tank 100; a plurality of the energizing units 15 provided within the hermetically-enclosed tank 100 around the blocking unit 14 about its axial line as the center away from each other; and a first wall (the fixed-side auxiliary conductor 300) provided between a first gas space (the space 50) in which the energizing units 15 are provided and a second gas space (the space 500) into which insulating gas, heated in the blocking unit 14 provided on the side of the fixed arc contact 20, is diffused. Further provided in the fixed-side auxiliary conductor 300 is a first communication hole (the communication hole 51) through which the gas space 50 provided between the energizing units 15 communicates with the gas space 500, so that the gas space 500 in the fixed-side cylindrical conductor 3 communicates with the gas space 50, accordingly enlarging relatively the gas capacity of the gas space 500. Consequently, the pressure difference between the gas pressure around the blocking unit 14 and the gas pressure in the gas space 500 becomes larger, thus increasing the flow velocity of hot gas generated in the blocking unit 14. As a result, the hermetically-enclosed tank 100 can be downsized while satisfying predetermined blocking performance, leading to a reduction in volume of the hermetically-enclosed tank 100 and an improvement in durability.

Second Embodiment

In the first embodiment, the communication hole 51 is formed on the fixed-side auxiliary conductor 300; but in a second embodiment, a communication hole 53 is also formed on the movable-side auxiliary conductor 400. Configurations other than those specific to the second embodiment are identical to the configurations of the first embodiment, and operations thereof are identical to those of the first embodiment. In the following descriptions, elements identical to those of the first embodiment are designated with same reference numbers, and explanations thereof will be omitted. Only elements different from those of the first embodiment are described below.

Figure 3:
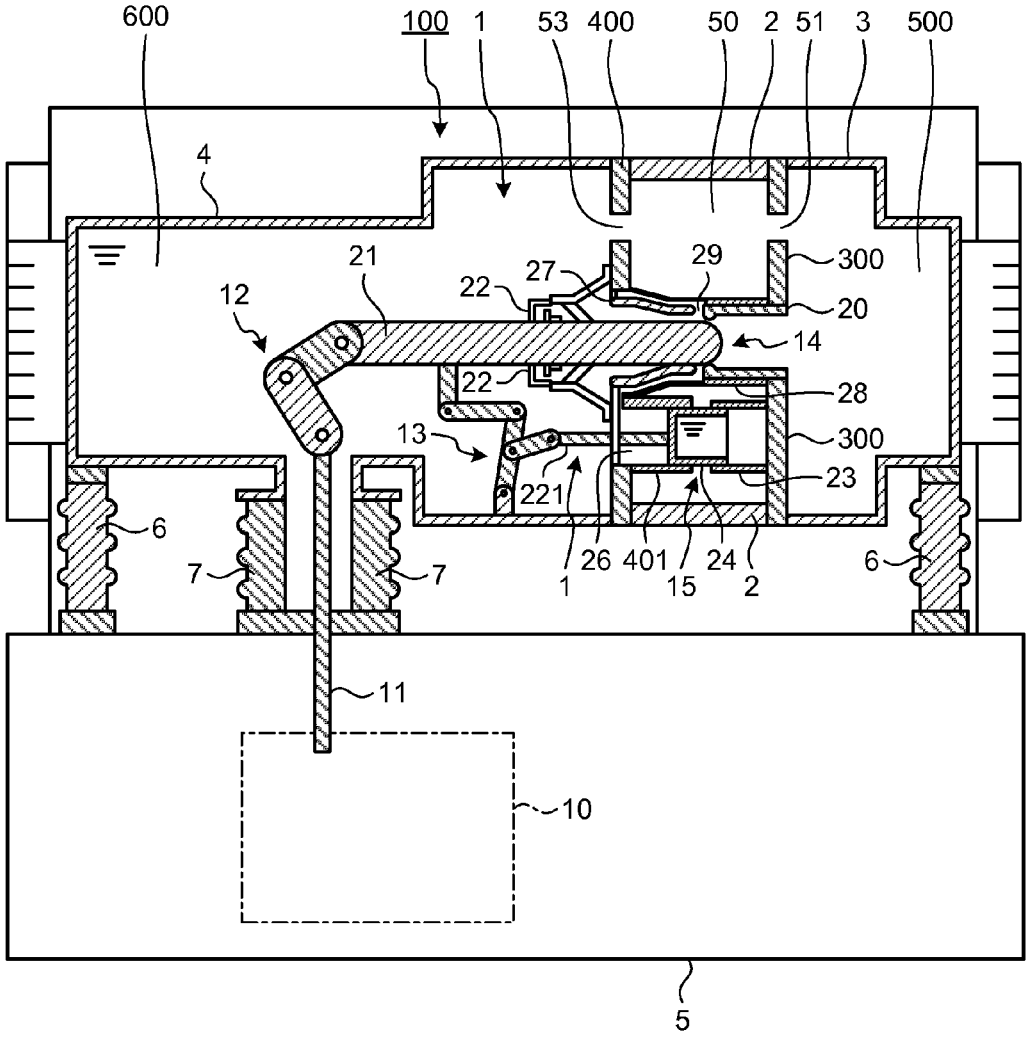
FIG. 3 is a vertical cross-sectional view illustrating a configuration of a gas circuit breaker according to a second embodiment of the present invention.

FIG. 3 is a vertical cross-sectional view illustrating a configuration of a gas circuit breaker according to the second embodiment of the present invention. The difference from the first embodiment lies in that the communication hole 53 is formed in the movable-side auxiliary conductor 400 at a position substantially opposing to the communication hole 51.

An operation of blocking an electric current is explained below. When a blocking operation generates an arc in an arc-generation area in the blocking unit 14, high-temperature hot gas generated by this arc flows into the gas space 500; in the gas space 500, gas that has been present in the gas space 500 is mixed with the hot gas flowing from the blocking unit 14, and thus increasing the pressure within the gas space 500; and part of the mixed gas flows into the gas space 50 through the communication hole 51. In the gas circuit breaker according to the second embodiment, the gas space 500, the gas space 50, and a gas space 600 in the movable-side cylindrical conductor 4 connect to each other through the communication hole 51 and the communication hole 53, so that the gas space 500 is relatively enlarged as compared with the first embodiment, which accordingly makes the difference between the gas pressure around the blocking unit 14 and the gas pressure in the gas space 500 larger. Consequently, hot gas generated in the blocking unit 14 flows to the gas space 500 at a higher velocity as compared with that in the first embodiment. Thus, the hot gas is discharged from the arc area more quickly, which makes it possible to further improve the blocking performance. Therefore, it is possible to further downsize the hermetically-enclosed tank 100 as compared with the first embodiment.

Further, when the movable arc contact 21 moves leftward shown in FIG. 3, a gas flow passage to the gas space 600 in the movable-side cylindrical conductor 4 is enlarged, so that the gas pressure in the arc-generation area is reduced and relatively higher-pressure insulating gas is blow down onto an arc. With this operation, the arc is extinguished and an electric current is blocked.

As explained above, in the gas circuit breaker according to the second embodiment, provided is a second wall (the movable-side auxiliary conductor 400) that separates the gas space 50 from a third gas space (the gas space 600) on a side of the movable arc contact 21; provided in the movable-side auxiliary conductor 400 is a second communication hole (the communication hole 53) through which the gas space 50 communicates with the gas space 600, so that the gas space 500, the gas space 50, and the gas space 600 in the movable-side cylindrical conductor 4 communicate with each other, thus, enabling a larger gas capacity of the gas space 500 than that in the first embodiment. Consequently, the flow velocity of hot gas generated in the blocking unit 14 can be further increased. As a result, the hermetically-enclosed tank 100 can further reduce in volume and improve in durability.

Third Embodiment

In the second embodiment, the communication hole 53 is formed in the movable-side auxiliary conductor 400; but in a third embodiment, a pipe 52 is further provided so as to communicate with the communication hole 51. Configurations other than those specific to the third embodiment are identical to the configurations of the second embodiment and operations thereof are identical to those of the second embodiment. In the following explanations, elements identical to those of the first and second embodiments are designated by the same reference numerals and explanations thereof will be omitted. Only elements different from those of the first and second embodiments are described below.

Figure 4:
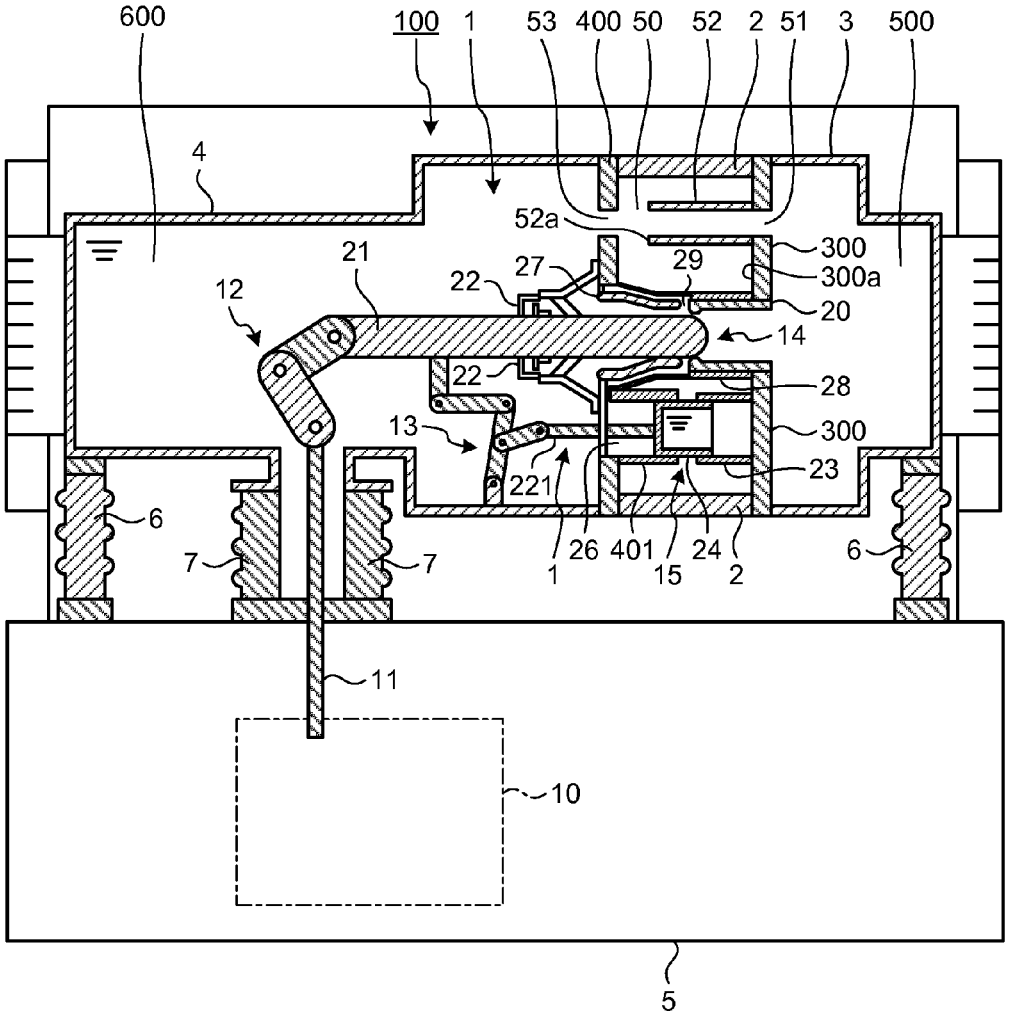
FIG. 4 is a vertical cross-sectional view illustrating a configuration of a gas circuit breaker according to a third embodiment of the present invention.

FIG. 4 is a vertical cross-sectional view illustrating a configuration of a gas circuit breaker according to the third embodiment of the present invention. The difference between the second embodiment and the third embodiment lies in that the pipe 52 that is formed with a smaller length than the axial length of the gas space 50 is provided on an energizing-unit side wall 300*a* of the fixed-side auxiliary conductor 300 so as to communicate with the communication hole 51. The pipe 52 is formed in a cylindrical shape having a larger diameter than the communication hole 51, for example.

An operation of blocking an electric current is explained below. When a blocking operation generates an arc in an arc-generation area in the blocking unit 14, high-temperature hot gas generated by this arc flows into the gas space 500; gas that has been present in the gas space 500 is mixed with the hot gas flowing from the blocking unit 14 in the gas space 500 so as to increase the pressure in the gas space 500; and part of the mixed gas flows into the pipe 52 through the communication hole 51. In the gas circuit breaker according to the third embodiment, the gas space 500, the gas space 50, and the gas space 600 in the movable-side cylindrical conductor 4 connect to each other through the communication hole 51 and the communication hole 53, so that the gas space 500 is relatively enlarged as compared with the first embodiment, and thus the difference between the gas pressure around the blocking unit 14 and the gas pressure in the gas space 500 further becomes larger. Consequently, hot gas generated in the blocking unit 14 flows to the gas space 500 at a higher velocity as compared with that in the first embodiment. Thus, the hot gas is discharged from the arc area more quickly, which makes it possible to further improve the blocking performance. Therefore, it is possible to further downsize the hermetically-enclosed tank 100 as compared with the first embodiment.

The pipe 52 is provided so as for gas that flows into the pipe 52 to flow nearly straight toward the communication hole 53 and to be discharged from an opening end 52*a* of the pipe 52. Then, a major portion of the gas discharged from the opening end 52*a* flows into the gas space 600 through the communication hole 53. Therefore, the possibility the gas, which flows into the pipe 52 from the gas space 500, blows down onto the energizing unit 15 can be reduced so as to reduce the risk of damaging energizing contacts (the movable energizing contact 24 and the fixed energizing contact 23) of the energizing unit 15 and a mechanical puffer by foreign substances contained in the gas.

Further, when the movable arc contact 21 moves leftward shown in FIG. 4, a gas flow passage to the gas space 500 in the movable-side cylindrical conductor 4 is enlarged so that the gas pressure in the arc-generation area is reduced and insulating gas with the pressure made high is blown onto the arc. With this operation, the arc is extinguished, and an electric current is blocked.

As explained above, in the gas circuit breaker according to the third embodiment, provided is a gas flow pipe (the pipe 52) that is formed with a smaller length than the axial length of the gas space 50 and that is provided on the fixed-side auxiliary conductor 300 to communicate with the communication hole 51, so that the same effects as those in the second embodiment can be obtained; further the risk for gas which flows into the pipe 52 from the gas space 500 to blow onto the energizing unit 15 can be reduced; and accordingly the risk of damaging the energizing contacts of the energizing unit 15 and damaging the mechanical puffer can be reduced.

Fourth Embodiment

In the third embodiment, the pipe 52 is provided so as to communicate with the communication hole 51; but, in a fourth embodiment, a pipe 52-1 is provided so as to communicate not only with the communication hole 51 but also with the communication hole 53. Configurations other than those specific to the fourth embodiment are identical with those of the third embodiment, which give the same operations. In the following explanations, elements identical to those of the first to third embodiments are designated by the same reference numerals and explanations thereof will be omitted. Only elements different from those of the first to third embodiments are described below.

Figure 5:
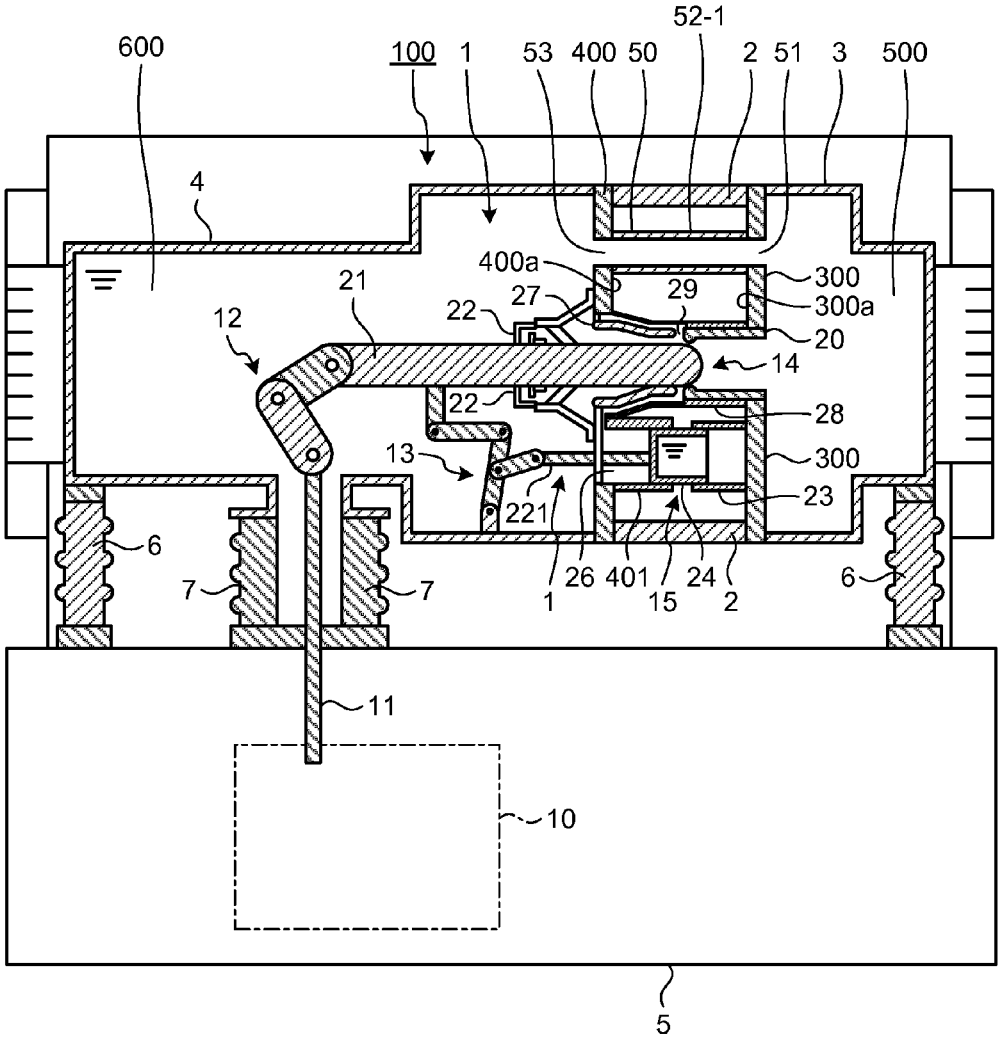
FIG. 5 is a vertical cross-sectional view illustrating a configuration of a gas circuit breaker according to a fourth embodiment of the present invention.

FIG. 5 is a vertical cross-sectional view illustrating a configuration of a gas circuit breaker according to the fourth embodiment of the present invention. Differences between the third embodiment and the fourth embodiment lie in that the pipe 52-1 is formed longer than that in the third embodiment; one end of the pipe 52-1 is provided on the energizing-unit side wall 300*a* of the fixed-side auxiliary conductor 300 so as to communicate with the communication hole 51; and the other end of the pipe 52-1 is provided on an energizing-unit side wall 400*a* of the movable-side auxiliary conductor 400 so as to communicate with the communication hole 53. The pipe 52-1 is formed into a cylindrical shape having a diameter larger than the communication hole 51 and the communication hole 53, for example.

An operation of the gas circuit breaker to block an electric current is explained below. Due to a blocking operation, generated is an arc in an arc-generation area in the blocking unit 14, and high-temperature hot gas generated by this arc flows into the gas space 500, where gas that has been present in the gas space 500 is mixed with the hot gas flowing from the blocking unit 14, thus increasing the pressure within the gas space 500. A part of the mixed gas flows into the pipe 52-1 through the communication hole 51. In the gas circuit breaker according to the fourth embodiment, the gas space 500 and the gas space 600 connect to each other through the communication hole 51, the pipe 52-1, and the communication hole 53, so that the gas space 500 is relatively enlarged as compared with that in the first embodiment, and accordingly the pressure difference between the gas pressure around the blocking unit 14 and the gas pressure in the gas space 500 further becomes larger. Consequently, hot gas generated in the blocking unit 14 flows to the gas space 500 at a higher velocity. Thus, the hot gas is discharged from the arc area more quickly, which makes it possible to further improve the blocking performance. Therefore, it is possible to achieve further downsizing of the hermetically-enclosed tank 100 as compared with the first embodiment.

By being provided with the pipe 52-1, gas that flows into the pipe 52-1 from the gas space 500 does not blow down onto the energizing unit 15, which makes it possible to reduce the risks of damaging energizing contacts of the energizing unit 15 and damaging a mechanical puffer due to foreign substances contained in the gas as compared with that in the third embodiment.

Further, when the movable arc contact 21 moves leftward shown in FIG. 5, a gas flow passage to the gas space 500 in the movable-side cylindrical conductor 4 is enlarged, so that the gas pressure in the arc-generation area is reduced and insulating gas with relatively higher-pressure is blown down onto an arc. This operation extinguishes the arc so as to block the electric current.

As explained above, in the gas circuit breaker according to the fourth embodiment, provided is the pipe 52-1 whose one end is provided on the movable-side auxiliary conductor 300 to communicate to the communication hole 51 and whose another end is provided on the movable-side auxiliary conductor 400 to communicate to the communication hole 53, which makes it possible to enhance the gas space 500 as compared with that of the first embodiment as well as to lessen the risk of damaging the energizing contacts of the energizing unit 15 and other parts.

The gas circuit breakers according to the embodiments of the present invention are simply examples of what the present invention is, and can be combined with other known techniques. It is needless to mention that the present invention can be configured while modifying without departing from the scope of the invention, such as omitting a part configured.

INDUSTRIAL APPLICABILITY

As described above, the present invention is applicable to a gas circuit breaker, and is particularly useful as an invention that can downsize a hermetically-enclosed tank while satisfying predetermined blocking performance.

REFERENCE SIGNS LIST

1 switching unit
2 insulating cylinder
3 fixed-side cylindrical conductor
4 movable-side cylindrical conductor
5 support stand
6, 7 support insulator
10 operation device
11 insulating operation rod
12, 13 link mechanism
14 blocking unit
15 energizing unit
20 fixed arc contact
21 movable arc contact
22 rod contact
23 fixed energizing contact
24 movable energizing contact
26 mechanical puffer chamber
27 insulating nozzle
28 insulating member
29 spraying flow passage
50 gas space (first gas space)
51 communication hole (first communication hole)
53 communication hole (second communication hole)
52, 52-1 pipe (gas flow pipe)
52*a* opening end
100 hermetically-enclosed tank
221 piston rod
300 fixed-side auxiliary conductor (first wall)
300*a*, 400*a* energizing-unit side wall
400 movable-side auxiliary conductor (second wall)
401 movable-side cylindrical conductor
500 gas space (second gas space)
600 gas space (third gas space)

The invention claimed is:

1. A gas circuit breaker comprising:
a hermetically-enclosed tank that is filled with insulating gas;
a blocking unit that is provided within the hermetically-enclosed tank and is configured with a movable arc contact and a fixed arc contact opposing each other;
a plurality of energizing units, within the hermetically-enclosed tank, that are provided around the blocking unit about its axial line as a center and located away from each other; and
a first wall that is provided between
a first gas space which stores the energizing units therein and
a second gas space into which insulating gas, heated in the blocking unit provided on a side of the fixed arc contact, is diffused, wherein
a first communication hole is formed on the first wall so as to communicate the first gas space provided between the energizing units with the second gas space.

2. The gas circuit breaker according to claim 1, wherein
a second wall is provided that separates the first gas space from a third gas space which is on a side of the movable arc contact, and
a second communication hole, formed on the second wall, through which the first gas space communicates with the third gas space.

3. The gas circuit breaker according to claim 2, comprising a gas flow pipe that is formed, on the first wall, with a smaller length than an axial length of the first gas space so as to communicate with the first communication hole.

4. The gas circuit breaker according to claim 2, comprising a gas flow pipe whose one end is provided on the first wall so as to communicate with the first communication hole and whose another end is provided on the second wall so as to communicate with the second communication hole.

* * * * *